US009756987B2

(12) United States Patent
Eriksson

(10) Patent No.: US 9,756,987 B2
(45) Date of Patent: Sep. 12, 2017

(54) UNDER MUD SHOWER PAN WITH SEAT

(71) Applicant: Innovative Leak Solutions, Inc., Oxnard, CA (US)

(72) Inventor: Leonard Eriksson, Oxnard, CA (US)

(73) Assignee: INNOVATIVE LEAK SOLUTIONS, INC., Oxnard, CA (US)

( * ) Notice: Subject to any disclaimer, the term of this patent is extended or adjusted under 35 U.S.C. 154(b) by 0 days.

(21) Appl. No.: 14/565,662

(22) Filed: Dec. 10, 2014

(65) Prior Publication Data

US 2015/0089735 A1 Apr. 2, 2015

Related U.S. Application Data

(63) Continuation-in-part of application No. 14/513,635, filed on Oct. 14, 2014, now abandoned, which is a continuation of application No. 12/789,432, filed on May 27, 2010, now Pat. No. 8,856,980.

(60) Provisional application No. 61/181,644, filed on May 27, 2009, provisional application No. 62/078,257, filed on Nov. 11, 2014.

(51) Int. Cl.
*A47K 3/28* (2006.01)
*A47K 3/40* (2006.01)

(52) U.S. Cl.
CPC ..... *A47K 3/282* (2013.01); *A47K 3/40* (2013.01); *Y10T 29/49826* (2015.01)

(58) Field of Classification Search
CPC ..... A47K 3/40; A47K 3/282; A47K 3/022; A47K 3/006
See application file for complete search history.

(56) References Cited

U.S. PATENT DOCUMENTS 3,955,219 A * 5/1976 Finch ..... A47K 3/006 4/552
8,112,831 B2 2/2012 Cook
9,179,807 B2 * 11/2015 Campbell ..... A47K 3/40
2005/0102746 A1 * 5/2005 Wright ..... A47K 3/006 4/555
2006/0026752 A1 2/2006 Torres
(Continued)

FOREIGN PATENT DOCUMENTS

JP 06-078859 3/1994

OTHER PUBLICATIONS

International Search Report for PCT/US2015/064773.
(Continued)

*Primary Examiner* — Janie Loeppke
(74) *Attorney, Agent, or Firm* — Risso I.P.

(57) ABSTRACT

Described is a one-piece shower pan with a seat having no openings for water leakage, other than the drain hole. The shower pan includes a drain hole designed to fit a conventional drain pipe such that when the conventional drain pipe is fastened to the shower pan, the conventional drain pipe extends ½ to 2 inches above the bottom of the shower pan. In this way, when cement or other adhesive is floated on the interior surface of the shower pan, tiles of varying thickness can be installed in such a manner that the top surface of the tiles are substantially flush with the top portion of the conventional drain pipe. The shower pan also has a water dam with a fin extending vertically on the outer edge of the water dam as added protection against water migration outside the shower pan.

6 Claims, 6 Drawing Sheets

(56) References Cited

U.S. PATENT DOCUMENTS

| | | | |
|---|---|---|---|
| 2010/0281612 | A1 | 11/2010 | Cook |
| 2010/0299827 | A1 | 12/2010 | Eriksson |

OTHER PUBLICATIONS

Written Opinion of the International Searching Authority for PCT/US2015/064773.
U.S. Appl. No. 14/669,997, Office Action dated Jan. 15, 2016.

* cited by examiner

UNDER MUD SHOWER PAN WITH SEAT

CROSS-REFERENCE TO RELATED APPLICATIONS

This application is a Continuation-in-Part application of U.S. Non-provisional application Ser. No. 14/513,635, filed on Oct. 14, 2014, which is a Continuation Application of U.S. Non-provisional application Ser. No. 12/789,432, filed on May 27, 2010, which is a non-provisional application of U.S. Provisional Application No. 61/181,644, filed on May 27, 2009, now issued as U.S. U.S. Pat. No. 8,856,980.

This is ALSO a non-provisional application of U.S. Provisional Application No. 62/078,257, filed on Nov. 11, 2014, and entitled, "Under Mud Shower Pan with Seat."

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, hut otherwise reserves all copyright rights whatsoever.

BACKGROUND OF THE INVENTION (1) Field of Invention

The present invention relates in general to shower pans and more specifically, to a prefabricated under mud shower pan with a seat that allows for tiles of varying thickness to be installed on the interior surface of the shower pan.

(2) Description of Related Art

Most shower pans are either custom-made or have a drain pipe already built into the shower pan. The problem with these is that it is difficult to install tiles in the interior surface of the shower pan. This can be due to several problems. First, some shower pans comprise curvatures that are not designed for placement of tile on them. Second, other shower pans have a drain pipe pre-installed in the shower pan so that if tiles were placed on the interior surface of the shower pan, they would not be flush with the drain pipe, making the horizontal floor area of the shower pan appear awkward. Third, custom-made shower pans with tiles pre-installed are limited to the tiles available to the manufacturer. Fourth, while it may be possible to glue tiles onto a shower pan, one cannot control the elevation of the tiles by floating cement over the surface of the shower pan, including the waterdam. Home builders or remodelers would not have the flexibility of installing tiles of their choosing, such as imported tiles, nor control the elevation of the tiles placed on the shower pan.

Various types of shower pans are known. By way of example, U.S. Pat. No. 6,990,695 issued to Grayson describes a shower pan for mounting in a shower stall that includes a single integrally molded base with a drain hole. A sidewall extends upward from the base and completely surrounds the base. A lateral ledge extends outward from the sidewall and has an inner edge and an outer edge defining a surface therebetween for mounting a shower stall door track. An outer ridge extends upward from the outer edge of the lateral ledge and is in spaced-apart relation to the door track. Water flowing through cracks between the door track and the shower pan is prevented from escaping the shower pan by the outer ridge, which allows water to drain under the door track into the shower pan. However, due to the curvatures in Grayson, it is not possible to install tiles. Furthermore, Grayson is not designed to be used with a conventional drain pipe.

Another example can be found in U.S. Pat. No. 6,003,169 issued to Davis, Jr., which describes a prefabricated, custom-built shower pan with a drain hole for use in a shower stall. The shower pan comprises an acrylic-based, solid surface upper layer; a polystyrene foam layer and a planar base layer with raised edges. The polystyrene foam layer is framed by the base layer and covered by the acrylic-based, solid surface upper layer. Also provided is a shower pan comprising an acrylic-based, solid surface upper layer; a base layer comprising a planar base with raised edges, a system of stringers, and a water dam. The stringers are substantially straight, horizontal wooden supports which collectively incline toward the drain hole. They are relatively evenly distributed within and adhere to the rectangular-shaped base. Each stringer has an incline on its upper surface, and one end abutting one edge of the base. However, Davis is a custom-built shower pan. It is not a shower pan that allows for a conventional drain pipe to be inserted in the drain hole such that the drain pipe rises approximately ½ to 2 inches above the horizontal surface of the shower pan, allowing for tiles of various thickness to be installed in a manner that the top of the tiles are flush with the top portion of the drain pipe.

Another example is U.S. Pat. No. 4,541,132 issued to Long, which describes a shower pan which forms a base of a shower stall. It has a one piece drain surface and is capable of being built in various sloping configurations. The shower pan is constructed of a top drain panel supported by graduated shims and perimeter strips which are in turn mounted on a planar foundation. Perimeter strips and graduated shims are secured to the foundation, concentrically spaced apart, surrounding a variably located drain opening. The top drain panel is cut to the same contour and size as the foundation and has a rear member, side members, and threshold members to provide lateral water barriers. Kerfed break lines in the top drain panel permit the panel to bend to form a basin like drain surface. The top drain panel is positioned and pressed down onto the shims at perimeter strips forming a drain basin with sloping panel sections defined by the kerfed break lines. A waterproof material such as hot mop tar is applied to the interior surfaces of the shower pan. An adhesive is then applied to all exposed surfaces and a finish covering such as ceramic tile or cultured marble is applied to the shower pan. The problem with Long is that it is comprised of separate pieces (side members and rear members) which create potential openings for water to escape, thereby requiring the need for a hot mop tar for waterproofing. Furthermore, the drain wipe does not rise up sufficiently high above the shower floor surface to allow for different tile sizes to be used, and the drain hole may not be suited for conventional drain pipes.

Thus, a continuing need exists for a shower pan with a seat that addresses the issues as presented in the prior art.

SUMMARY OF INVENTION

The present invention relates in general to shower pans. More specifically, described is a one piece prefabricated shower pan with a seat that is designed for easy installation of tiles of various thickness, having a drain hole designed to fit a conventional drain pipe such that the pipe rises anywhere above the shower floor surface (e.g., anywhere from ¼ inch to 4 inches, desirably ¼ to 2 inches) to accommodate tiles of varying thickness so that the top of the tiles are substantially flush with the top portion of the drain pipe. The prefabricated shower pan comprises a horizontal floor area and a drain hole positioned substantially on a center portion. The horizontal floor area is gradually inclined towards the drain hole. The prefabricated shower pan further includes a pair of opposing sidewalls extending upwardly from a peripheral edge of the horizontal floor area and a third sidewall extending upwardly from the peripheral edge of the horizontal floor area. One of the opposing sidewalls rises to a vertical edge, with a seat extending laterally from the vertical edge. The third sidewall is in contact with a back end of the pair of opposing sidewalls and the laterally extending Seat. The pair of opposing sidewalk and the third side all are arranged to form a rectangular shape or any other desired shape.

In another aspect, the prefabricated shower pan further includes a water dam extending upwardly from the peripheral edge of the horizontal floor area. The water dam has a lower height relative to the pair of opposing sidewalls and the third sidewall. The water dam is in contact with a front end of the pair of opposing sidewalls. The prefabricated shower pan has no openings other than the drain hole for water to escape. The interior surface of the prefabricated shower pan has a sand-finished surface to provide good bonding with cement or other adhesive for placing shower tiles. The shower tiles can also be placed over a wall system inserted inside the shower pan.

In another aspect, the shower pan includes a drain that both rises up from and projects down from the horizontal floor area, with the at least one drain hole formed within the drain.

Finally, as can be appreciated by one in the art, the present invention also comprises a method for forming and using the invention described herein.

Although particular embodiments of the present invention have been described in the foregoing description, it is to be understood that the present invention is not to be limited to just the embodiments disclosed, but that they are capable of numerous rearrangements, modifications and substitutions without departing from the description herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
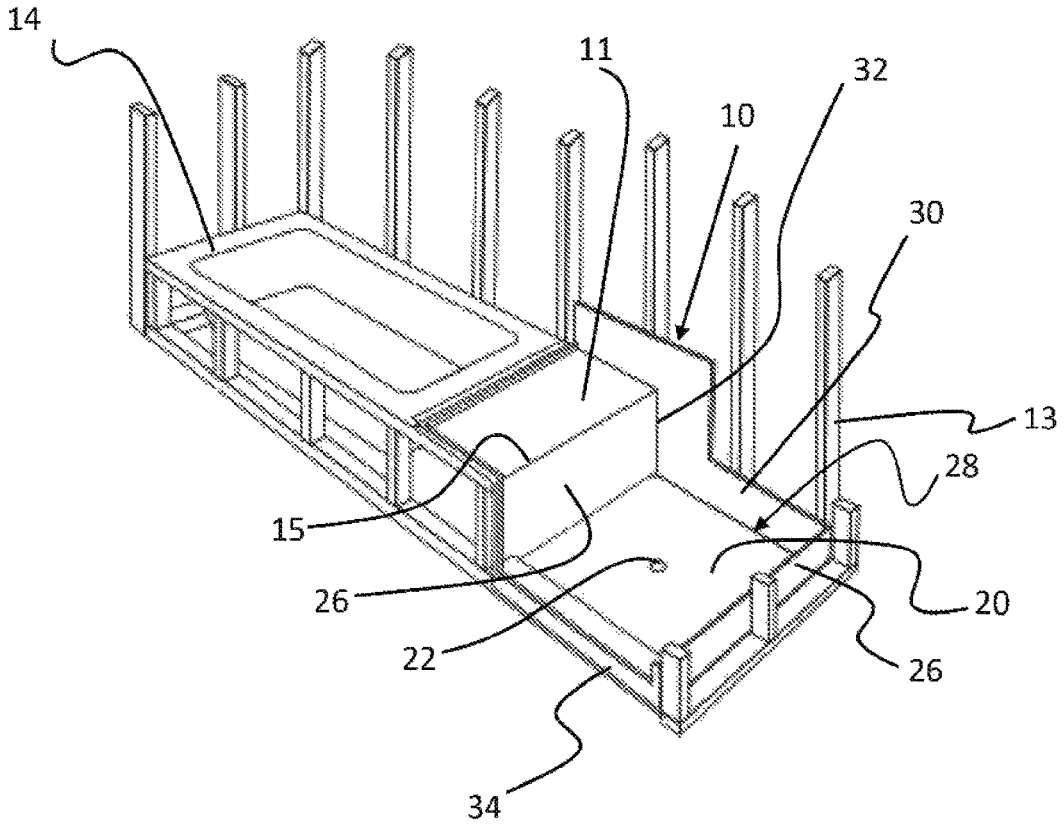
FIG. 1 is a perspective-view illustration of a one-piece prefabricated shower pan with a seat according to the principles of the present invention, depicting an aspect where the seat is to the left of an entrance.

The present invention relates in general to shower pans and, more specifically, to a prefabricated under mud shower pan with a seat that allows for tiles of varying thickness to be installed on the interior surface of the shower pan, and for added protection against water migration. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments, Thus, the present invention is not intended, to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention, The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

As noted above and as illustrated in FIG. 1, described is a prefabricated under mud shower pan 10 with a seat 11 that allows for tiles of varying thickness to be installed on the interior surface of the shower pan. The shower pan 10 is designed for tiling and with additional protection against water migration outside the shower pan 10. Also included in the prefabricated shower pan 10 is a seat 11 form that allows the entire shower pan 10 (with its seat 11) to be installed at a site with mud and tile thereafter being applied. For illustrative purposes, the shower pan 10 is illustrated as installed at the site between studs 13 and adjacent a bathtub 14.

Referring to FIG. 1, the prefabricated shower pan 10 comprises a pair of opposing sidewalls 26 extending upwardly from a peripheral edge 28 of a horizontal floor area 20 and a third sidewall 30 extending upwardly from the peripheral edge 28 of the horizontal floor area 20 so that the side walls and the horizontal floor area form a near 90 degree angle. The angle is a near 90 degree angle because the horizontal floor area is inclined toward the center portion of the shower pan so that, depending on the extent of the incline, the angle formed by the meeting of the sidewalls and the horizontal floor area can be 90 degrees or more. Thus, although the horizontal floor area 20 is not entirely horizontal as it is desirably sloped or inclined slightly toward the center portion of the floor area 20. The slope or incline is any suitable or desired slope as understood by those skilled in the art, non-limiting examples of which include being between 1 degrees and 30 degrees off of horizontal.

The third sidewall 30 is in contact with a back end 32 of the pair of opposing sidewalls 26. The pair of opposing sidewalls 26 and the third sidewall 30 are arranged to form any desired shape therebetween, non-limiting examples of which include a rectangular shape and a square shape.

Still referring to FIG. 1, the horizontal floor area 20 has at least one drain hole 22 positioned substantially on a center portion (or at any suitable or desired portion). The circumference of the drain hole 22 is wide enough for a conventional drain pipe to be inserted through it and a depression (shown in FIG. 3 as 45) borders the drain hole 22 so that a conventional drain pipe can be fastened to the horizontal floor area 20 with flanges.

Notably, one of the side walls (either one of the opposing side walls 26 or the third side wall 30) rises to a vertical edge 15, with the seat 11 extending laterally from the vertical edge 15. It should be noted that the seat 11 can be formed to extend laterally from any of the side walls. However, desirably and in one aspect, the seat 11 extends laterally from one of the opposing side walls 26. In this aspect, the third sidewall 30 is in contact with a back end of the pair of opposing sidewalls 26 and the seat 11 extending laterally. In one aspect, the third sidewall 30 is sufficiently long such that it extends at least along the entire length of the seat 11. Further, the seat 11 is formed at an incline slightly with respect to the side wall 26 and its vertical 15, such that water will drain down the seat and toward the drain hole 22.

It should be noted that the under mud shower pan 10 with its seat 11 can be formed in a variety of configurations according to the principles of the present invention. For example, FIG. 1 illustrates an aspect in which a water dam 34 is formed at a front side or entrance to the shower pan 10.

In a desired aspect, the water dam 34, pair of opposing sidewalls 26 and third sidewall 30, seat 11, and other components of the shower pan 10 described herein, are all seamlessly connected with one another to provide a water proof barrier and a one-piece prefabricated component. Thus, in one aspect, the components described herein are prefabricated of any suitable material, non-limiting examples of which include fiberglass and plastic.

Figure 2:
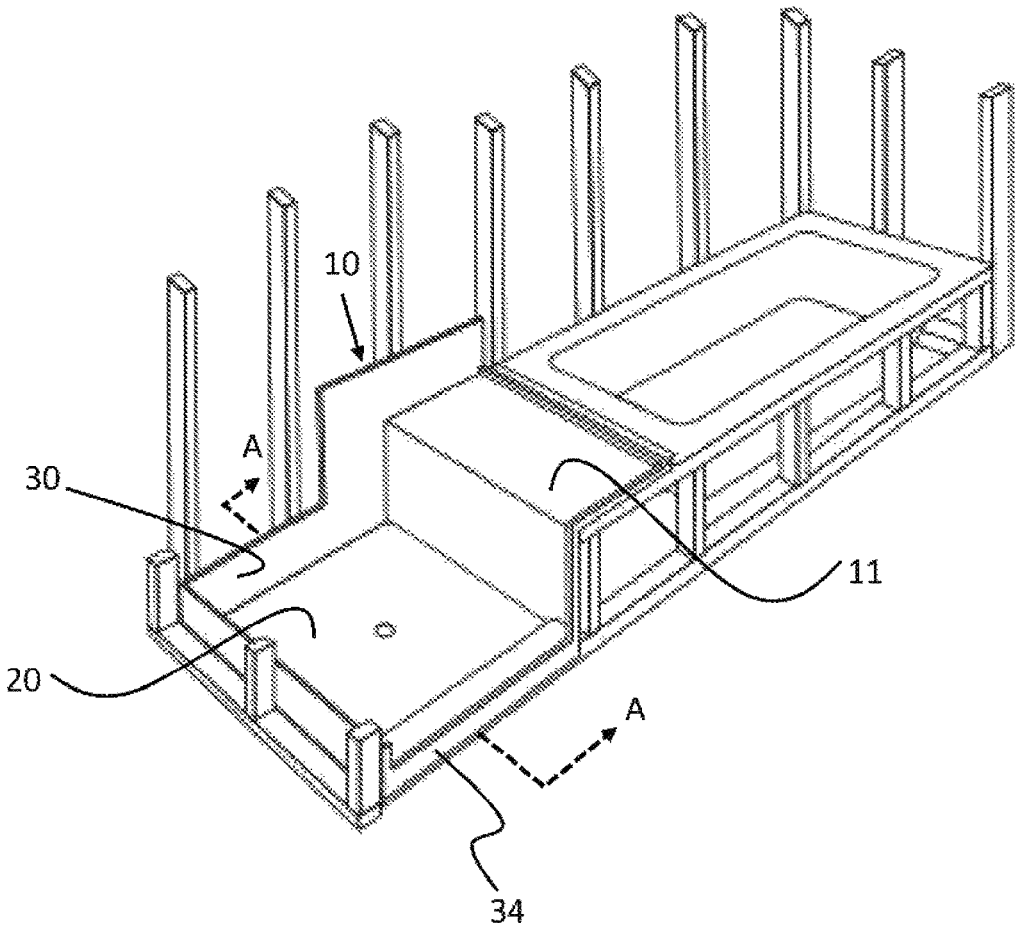
FIG. 2 is a perspective-view illustration of the one-piece prefabricated shower pan with a seat according to the principles of the present invention, depicting an aspect where the seat is to the right of the entrance.

In the aspect depicted in FIG. 1, the seat 11 is formed to the left of the water dam 34 and floor area 20. Alternatively and as shown in FIG. 2, the shower pan 10 can be formed such that the seat 11 is to the right of the water dam 34 (entrance) and floor area 20. In yet another aspect (not depicted), the shower pan 10 can be formed such that the seat 11 extends off of the sidewall 30 that opposes the water dam 34 such that it is neither left or right, but in front of the user as the user enters the shower. Thus and as can be appreciated by those skilled, in the art, the seat 11 can be formed to extend laterally off of any of the sidewalls as desired.

Figure 3:
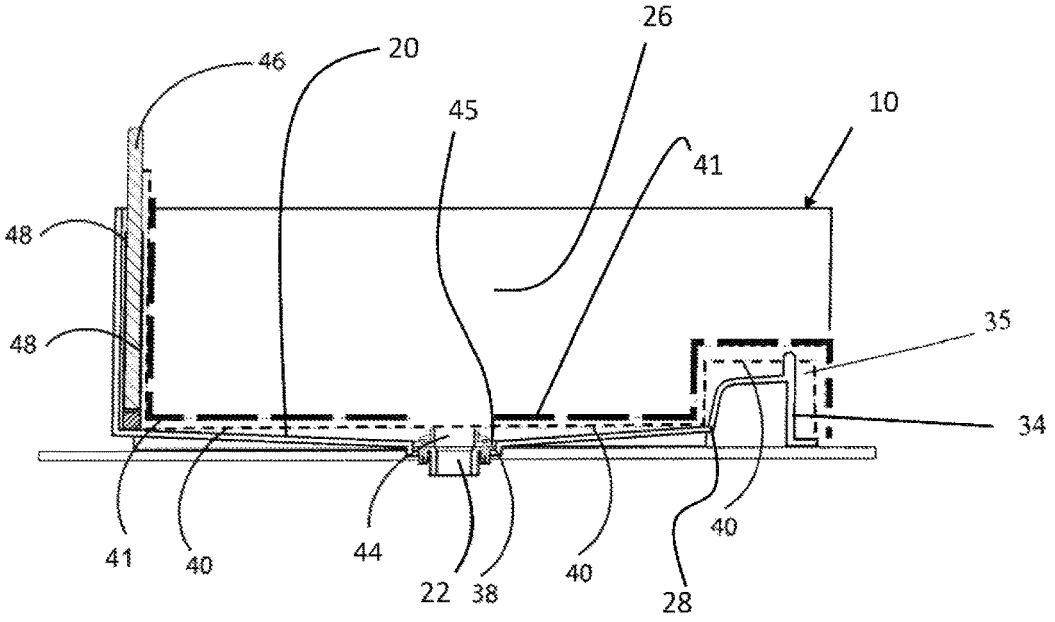
FIG. 3 is a sectional-view illustration of the present invention taken generally along the lines A-A of FIG. 2.
Figure 4:
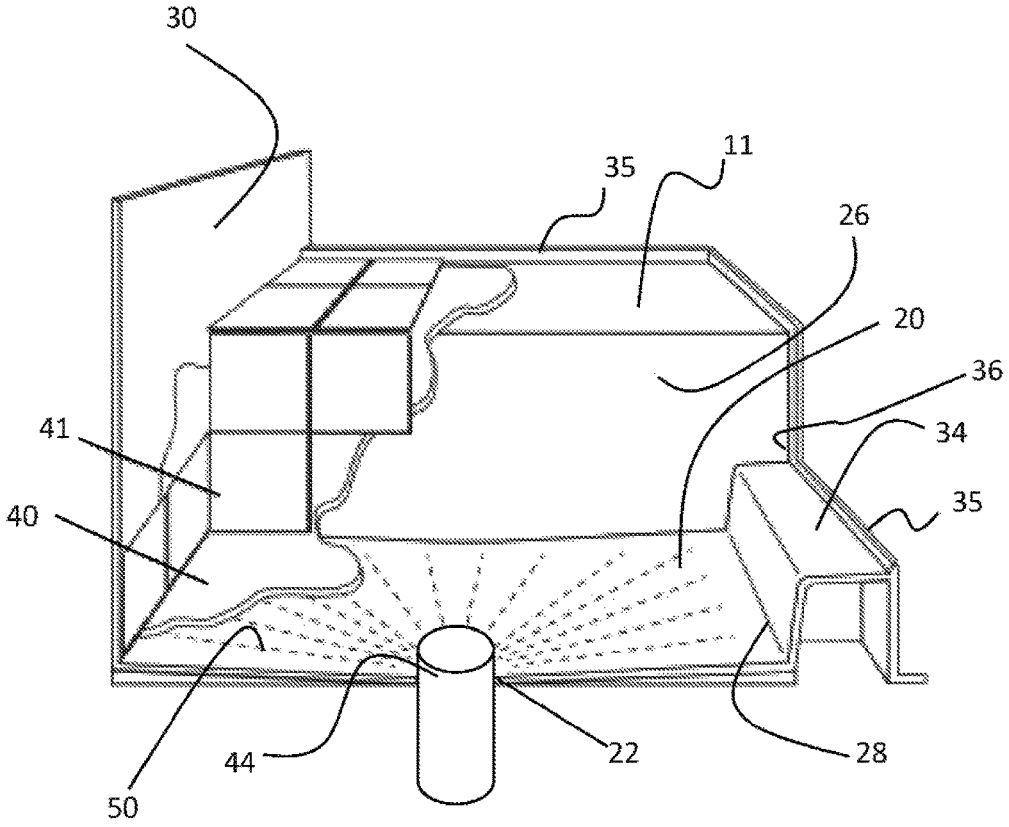
FIG. 4 is a cut-away view of the present invention, illustrating a conventional drain pipe fastened to the surface of the horizontal floor area of the shower pan.

For further understanding, FIG. 3 is a cross sectional view of an aspect generally taken along the lines A-A of FIG. 2. FIG. 4 is a cut-away view of the present invention, illustrating a conventional drain pipe 44 fastened to the surface of the horizontal floor area 20 of the shower pan 10, Referring to FIGS. 3 and 4, when a conventional drain pipe 44 is inserted through the drain hole (shown as element 22 in FIG. 1) and fastened to the shower pan (using flanges 38 and weep holes), at least ½ to 2 inches of the pipe extends above the interior surface of the horizontal floor area. In this way, an adhesive 40 (e.g., cement, mortar, thin-set, etc.) can be floated on the interior surface of the horizontal floor area and tiles 41 of varying thickness can be placed on top of the adhesive 40 such that the top surface of the tiles 41 are even with the top portion of the conventional drain pipe 44. Allowing for a drain pipe to extend beyond the interior surface of the horizontal floor area by ½ to 2 inches allows for tiles 41 of varying thickness to be placed on the horizontal floor area. The more thin a tile 41 is, the more adhesive 40 will be required so that the top surface of the tile 41 will be even with the top of the conventional drain pipe 44, and the more thick a tile 41 is, the less adhesive 40 would be used to make the top of the tile substantially flush with the top portion of the conventional drain pipe 44. Since the horizontal floor area 20 is inclined toward the center portion of the shower pan 10, it is more important that the tiles 41 bordering the drain hole are substantially flush with the top portion of the conventional drain pipe 44. The adhesive 40 is also placed over the waterdam 34, sidewalls 26 and 30, and seat 11, all of which can also have tile 41 applied thereto.

In FIG. 3, the broken lines simulate the placement of tile 41 on cement or other adhesive 40 so that the top of the tiles 41 are flush with the top of the conventional drain pipe 44. In a desired aspect, the horizontal floor area 20 of the prefabricated, shower pan 10 has a sand finished surface (not shown) to provide good bonding with the adhesive 40 for placing shower tiles 41.

FIG. 3 provides an illustration depicting tile being placed over a walling system 46 used in conjunction with the shower pan 10, wherein the walling system 46 is inserted in the inside of at least one sidewall of the shower pan and wrapped in butyl tape 48 (or any other suitable adhesive and barrier material) to ensure a strong bond and create a water proof barrier to prevent water migration up the wall system 46. The wall system can be a foam-based backer board.

Referring to FIGS. 3 and 4, the horizontal floor area 20 is gradually inclined towards the drain hole 22.

With reference to FIGS. 1 through 4, the prefabricated shower pan 10 further includes a waterdam 34 extending upwardly from the at least one peripheral edge 28 of the horizontal floor area 20. The waterdam 34 has a lower height relative to the pair of opposing sidewalls 26 and the third sidewall 30. In one aspect, the waterdam 34 is in contact with a front end 36 of the pair of opposing sidewalls 26. The top surface of the waterdam 34 is sloped inward toward the center portion of the shower pan 10. In addition, the waterdam 34 has a fin 35 extending vertically on its outside edge to provide additional protection against water migration outside the shower pan in the event water penetrates the overlaid tile and cement. Notably, the seat 11 also includes such a fin 35 that extends vertically on its outside edges. In this way, migrating water will fall back into the shower pan 10.

In another aspect, troughs 50 jut outwardly from the drain hole 22 to facilitate the exit of water down the drain hole 22.

Figure 5:
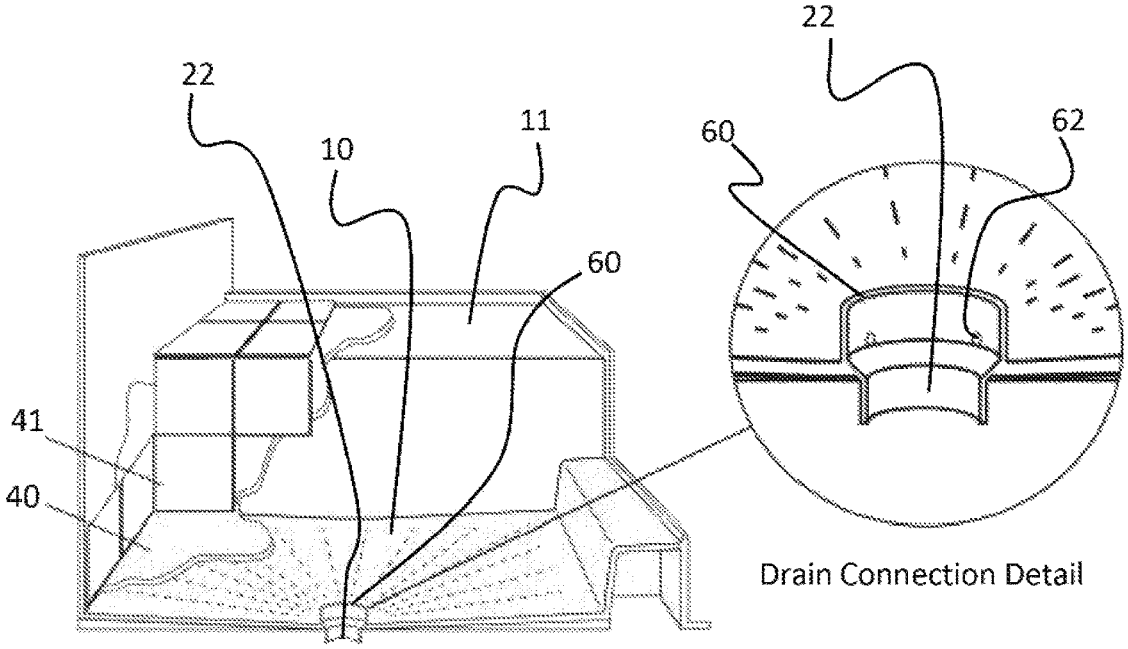
FIG. 5 is a cut-away view of the present invention, illustrating a drain as being integrally formed with the shower pan.

Another aspect is depicted in FIG. 5, which illustrates the under mud shower pan 10 with its seat 11. Although similar to the aspects as illustrated in FIGS. 1 through 4, the shower pan 10 shown in FIG. 5 shows a drain 60 that is formed as part of the pan 10 and made of the same material as the pan 10. As a non-limiting example, the drain 60 is integrally molded or formed with the pan 10 as a single piece. The drain 60 can be formed in any desired shape or dimension. As a non-limiting example, the drain 60 can be formed to look like and be shaped similar to that of a conventional cast iron drain and/or plastic drain. For example, the drain 60 can be formed to rise from the pan 10 floor from between approximately two to three inches, and project down from the pan 10 floor between approximately two to three inches (or any other suitable dimensions as desired and/or needed), with the actual dram hole 22 within the drain 60. Weep holes 62 can be formed through the drain 60 to allow any errant fluid to drain from the pan 10 into the drain hole 22. The drain 60 can also be formed to accommodate a drain cover screen.

An advantage to the aspect as illustrated in FIG. 5 is that the integrally molded or formed drain 60 can be used in place of a conventional drain, thereby decreasing the likelihood of leakage points. In this aspect, the pan 10 is fastened to a drain pipe that is glued or otherwise adhered to the bottom portion of the pan.

Figure 6:
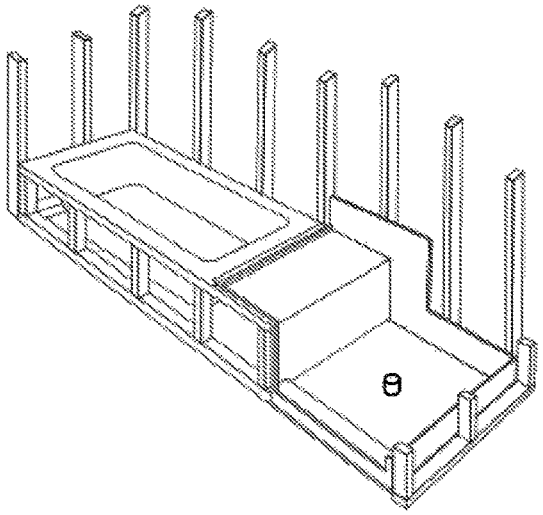
FIG. 6 is a perspective-view illustration of the one-piece prefabricated shower pan with a seat as shown in FIG. 5, depicting an aspect where the seat is to the left of the entrance.
Figure 7:
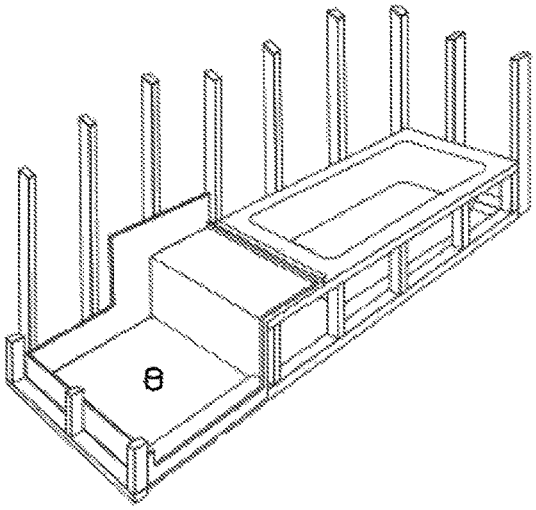
FIG. 7 is a perspective-view illustration of the one-piece prefabricated shower pan with a seat as shown in FIG. 5, depicting an aspect where the seat is to the left of the entrance.

For further understanding, FIG. 6 is a perspective-view illustration of the one piece prefabricated shower pan with a seat as shown in FIG. 5, depicting an aspect where the seat is to the left of the entrance. Finally. FIG. 7 is a perspective-view illustration of the shower pan as shown in FIG. 5, depicting an aspect where the seat is to the left of the entrance. Thus, as can be appreciated, the invention is not limited to any specific configuration.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A one-piece prefabricated shower pan with a seat, comprising:

a horizontal floor area having at least one drain hole, the horizontal floor area having a top surface and a bottom surface, the top surface being gradually inclined towards the at least one drain hole;

a pair of opposing sidewalls extending upwardly from a peripheral edge of the horizontal floor area at a near 90 degree angle;

wherein one of the opposing sidewalls rises to a vertical edge, with a seat extending laterally from the vertical edge;

a third sidewall extending upwardly from the peripheral edge of the horizontal floor area at a near 90 degree angle, the third sidewall being in contact with a back end of the pair of opposing sidewalls and the laterally extending seat; and a water dam extending upwardly from the at least one peripheral edge of the horizontal floor area; and a drain that is integrally formed with the horizontal floor area and that includes surrounding walls that both rise up from the top surface and project down from the bottom surface, with the at least one drain hole formed within the drain and surrounded by the surrounding walls.

2. The one-piece prefabricated shower pan with a seat of claim 1, wherein the water dam has a lower height relative to the pair of opposing sidewalls and the third sidewall.

3. The one-piece prefabricated shower pan with a seat of claim 2, wherein the water dam has a top surface slanted toward the center of the shower pan and a fin extending vertically from the outside edge of the water dam to safeguard against water migration outside the shower pan.

4. The one-piece prefabricated shower pan with a seat of claim 1, wherein the water dam has a top surface slanted toward the center of the shower pan and a fin extending vertically from the outside edge of the water dam to safeguard against water migration outside the shower pan.

5. The one-piece prefabricated shower pan with a seat of claim 1, wherein the at least one drain hole has a circumference that allows for a conventional drain pipe to be inserted through it and a depression around the borders of the drain hole to allow a conventional drain pipe to be fastened to the horizontal floor area with the use of flanges, such that when the conventional drain pipe is fastened to the horizontal floor area, the conventional drain pipe extends above the horizontal floor area, and wherein there are no openings in the shower pan for water to escape, other than the drain.

6. The one-piece prefabricated shower pan with a seat as set forth in claim 1, wherein the drain rises from the top surface of the horizontal floor area from between two to three inches and projects down from the bottom surface between two to three inches.

* * * * *